US006135427A

United States Patent [19]

Tsai

[11] Patent Number: 6,135,427

[45] Date of Patent: Oct. 24, 2000

[54] HUMIDIFIER

[75] Inventor: Tony Teh-Feng Tsai, Tainan, Taiwan

[73] Assignee: Kaz, Incorporated, New York, N.Y.

[21] Appl. No.: 09/227,755

[22] Filed: Jan. 8, 1999

[51] Int. Cl.[7] ..... B01F 3/04

[52] U.S. Cl. ..... 261/26; 261/81; 261/DIG. 34; 261/DIG. 48

[58] Field of Search ..... 261/26, 72.1, 81, 261/DIG. 34, DIG. 48, DIG. 69

[56] References Cited

U.S. PATENT DOCUMENTS

| | | | |
|---|---|---|---|
| 4,563,313 | 1/1986 | Tsuaki | 261/81 |
| 4,643,351 | 2/1987 | Fukamachi et al. | 261/DIG. 48 |
| 4,644,790 | 2/1987 | Mizoguchi | 261/DIG. 65 |
| 4,752,423 | 6/1988 | Wong | 261/DIG. 48 |
| 4,820,453 | 4/1989 | Huang | 261/26 |
| 4,853,161 | 8/1989 | Huang | 261/81 |
| 4,882,096 | 11/1989 | Rueben | 261/81 |
| 4,921,639 | 5/1990 | Chiu | 261/81 |
| 5,131,070 | 7/1992 | Chiu et al. | 392/405 |
| 5,252,260 | 10/1993 | Schuman | 261/26 |
| 5,397,510 | 3/1995 | Clark | 261/26 |
| 5,792,390 | 8/1998 | Marino | 261/72.1 |
| 5,918,804 | 7/1999 | Jung | 261/DIG. 48 |

FOREIGN PATENT DOCUMENTS

| | | | |
|---|---|---|---|
| 62-218759 | 9/1987 | Japan | 261/DIG. 48 |
| 62-242741 | 10/1987 | Japan | 261/DIG. 48 |
| 4-278138 | 10/1992 | Japan | 261/DIG. 48 |

*Primary Examiner*—Duane S. Smith
*Attorney, Agent, or Firm*—Darby & Darby

[57] ABSTRACT

A compact, small size humidifier which may be used as a portable humidifier. The humidifier may include the appropriate electrical plugs and internal electrical transformer to allow use in different countries with different voltages and electrical power systems, e.g., 110V use in the United States, 220V use in Europe, etc. The humidifier also includes an opening for receiving a number of different sockets allowing use of different sized water bottles as the water tank. The different sockets may be detachably affixed to the humidifier body in appropriate recesses or holding arrangements so that the different sockets are easily made available to the user. The humidifier may also include a low water detection assembly which utilizes, e.g., two projecting probes positioned in the water retaining chamber, to indicate the presence of a sufficient amount of water. Conversely, when the water drops below a certain, safe level, there is no longer an electrical signal indicated by one or both of the two probes, indicating that the water is below a certain threshold level. This indication is then used to shut off the humidifier to prevent damage to the unit, as well as any possible accident or injury.

19 Claims, 12 Drawing Sheets

HUMIDIFIER

FIELD OF THE INVENTION

The present invention relates generally to the field of humidifiers. More specifically, the present invention relates to a compact, portable humidifier which may be used with a number of different water containers.

BACKGROUND OF THE INVENTION

The present invention relates to a humidifier, and particularly to one which is used for adding moisture to the atmosphere in the room when it is too dry in order to improve the atmosphere in the room, as well as preventing the skin of people from becoming too dry. Various prior art humidifiers are shown in, e.g., U.S. Pat. Nos. 4,921,639; 5,131,070; 5,397,510; and 5,792,390, the contents of which are incorporated herein by reference.

A heretofore known humidifier, referring to FIG. 15, comprises a main body 10 and a water tank 20 as main parts. The main body 10 has a water containing chamber 101 and a propping rod 102. The water tank 20 is removably connected to the upper side of the main body 10. The water tank 20 is specifically shaped and configured to mate with the main body 10. The water tank 20 includes a valve device 201 which normally prevents water held inside the water tank 20 from flowing out, and is opened for the water to flow therethrough when the water tank 20 is connected to the main body 10 with the propping rod 102 pushing the valve device 201 upwards. A vapor exit opening 202 is arranged on the upper side of the water tank 20; the vapor exit opening 202 is further isolated from the water held inside the tank 20, but communicates with the water containing room 101 of the main body.

Water held in the water containing chamber 101 of the main body is transformed into vapor by a vibrating device in the main body 10 (not shown), and sent out from the vapor exit opening 202 to the atmosphere.

Thus, moisture in the atmosphere is increased. However, it is found that the humidifier has several undesired features, including:

1. It is generally of a large size, and is not suitable as a compact device.
2. Only specific water tanks having a uniquely configured lower side that fit the main body can be used in this humidifier, i.e., the humidifier cannot use other water tanks of different sizes or shapes.
3. When the water tank is damaged, the user has to buy a new one that fits the main body, making the replacement inconvenient and costly.
4. Not having safety means, the humidifier will keep on producing vapor when the water tank is removed. So, when the water tank is accidentally removed from the main body, it is likely that the water comes out and wets the floor or that the vapor injures people nearby.
5. Not having a water detecting means, the humidifier will continue to work even when the water supply is exhausted. The user must therefore exercise great care in using the humidifier. And, if the user does not cut off the power supply and allows the humidifier to continue to work when the water supply is exhausted, the humidifier might be damaged or might cause accident, injury or even a fire.

SUMMARY OF THE INVENTION

It is therefore a main object of the present invention to provide a compact, small size humidifier, which can be easily carried around without being too heavy or taking up too much space.

It is another object of the present invention to provide a humidifier which can use water bottles of different size and configurations as the water tank. This obviates the need for the user to carry a specialized water tank for use with the humidifier.

It is also an object of the present invention to provide a humidifier, which provides certain safety features not found in prior art devices.

The humidifier of the present invention is a compact, small size humidifier which may be used as a portable humidifier. The humidifier may include the appropriate electrical plugs and internal electrical transformer to allow use in different countries with different voltages and electrical power systems, e.g., 110V use in the United States, 220V use in Europe, etc. The humidifier also includes an opening for receiving a number of different sockets allowing use of different sized water bottles as the water tank. The different sockets may be detachably affixed to the humidifier body in appropriate recesses or holding means so that the different sockets are easily made available to the user. The humidifier may also include a low water detection assembly which utilizes, e.g., two projecting probes positioned in the water retaining chamber, to indicate the presence of a sufficient amount of water. Conversely, when the water drops below a certain, safe level, there is no longer an electrical signal indicated by one or both of the two probes, indicating that the water is below a certain threshold level. This indication is then used to shut off the humidifier to prevent damage to the unit, as well as any possible accident or injury.

BRIEF DESCRIPTION OF THE DRAWINGS

The present invention will be better understood by reference to the accompanying drawings, wherein.

DETAILED DESCRIPTION OF PREFERRED EMBODIMENTS

Figure 1:
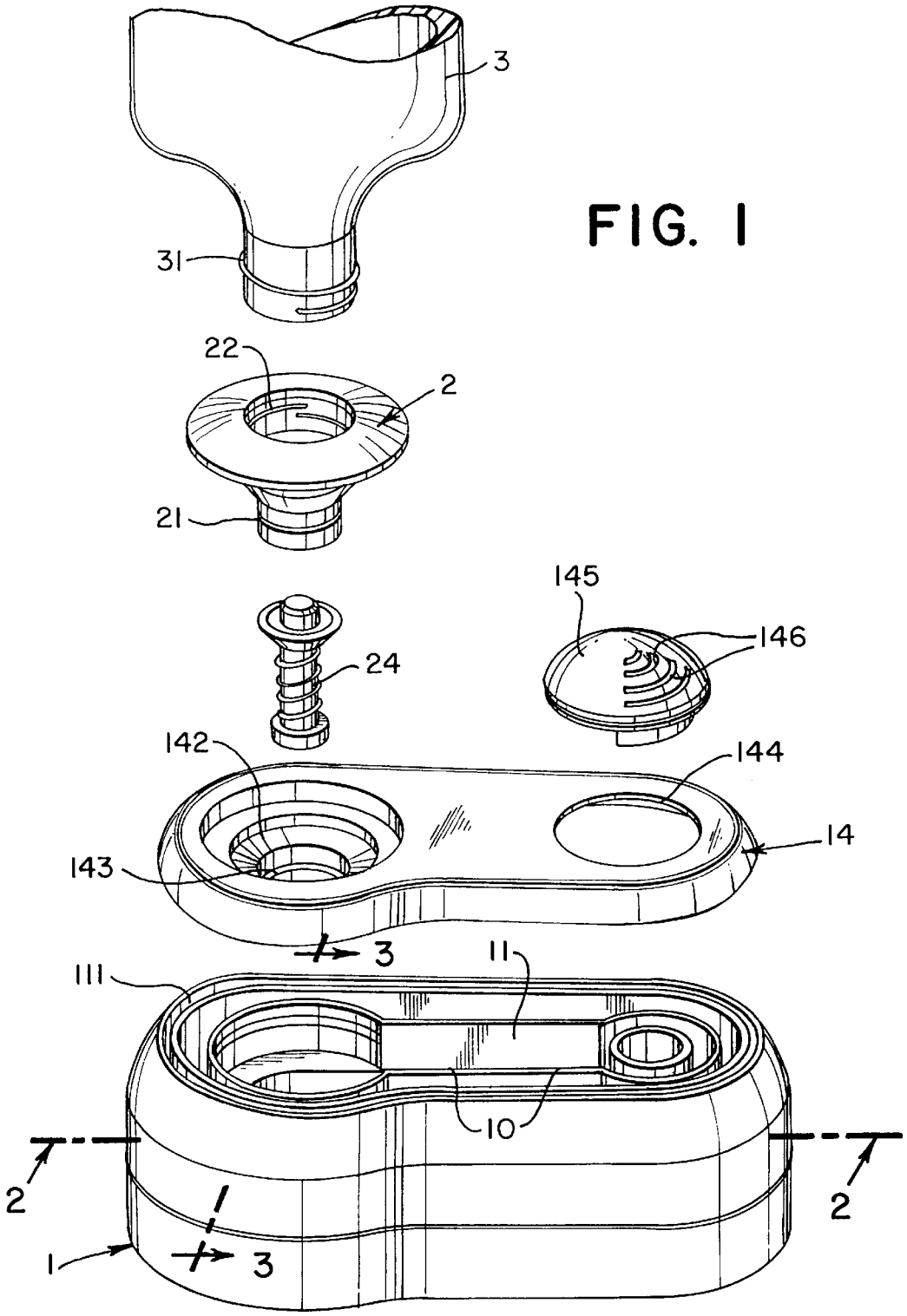
FIG. 1 is an exploded perspective view of a humidifier of the present invention.
Figure 2:
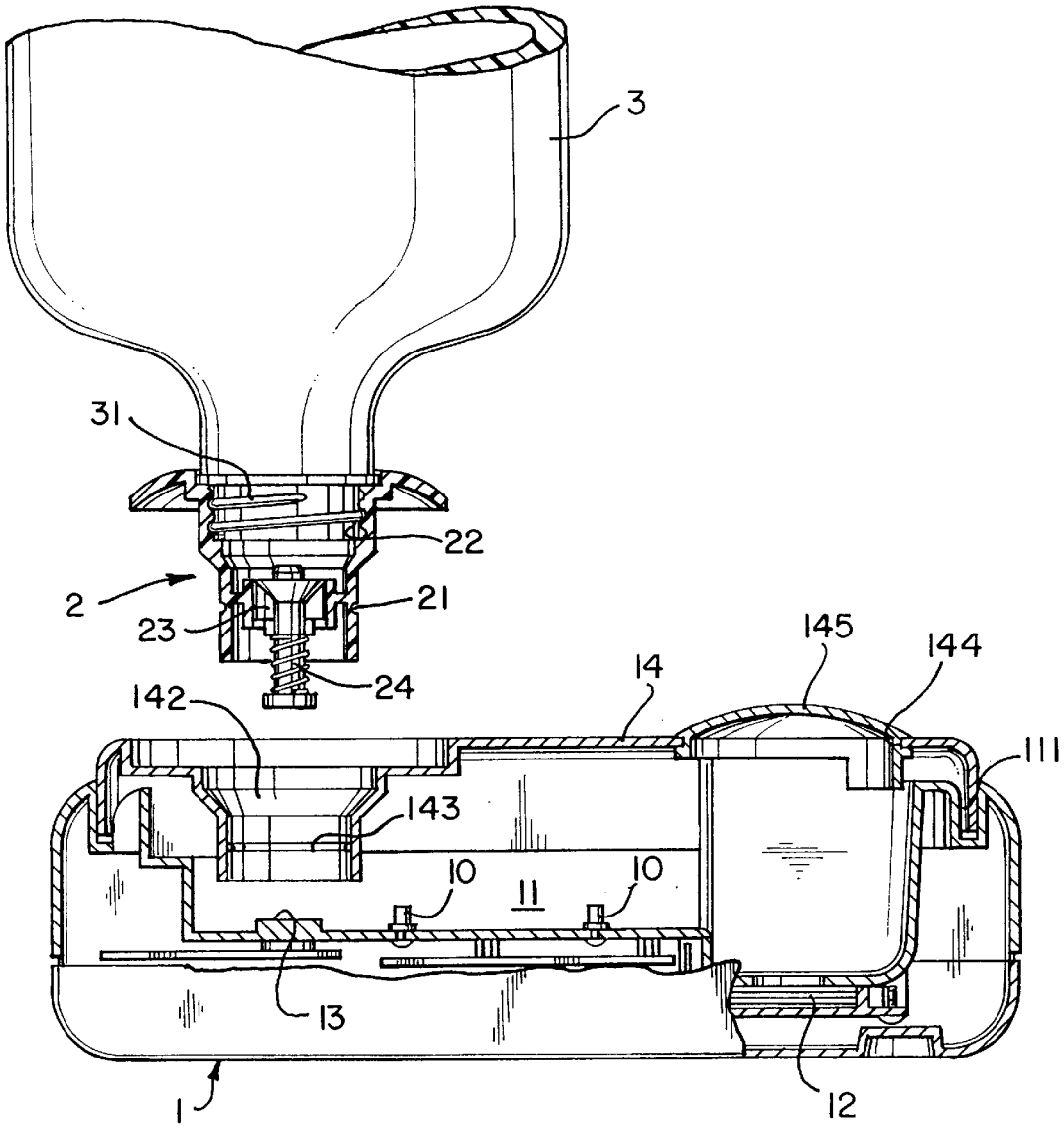
FIG. 2 is a sectional view of the humidifier of the present invention along the line 2—2 of FIG. 1.
Figure 3:
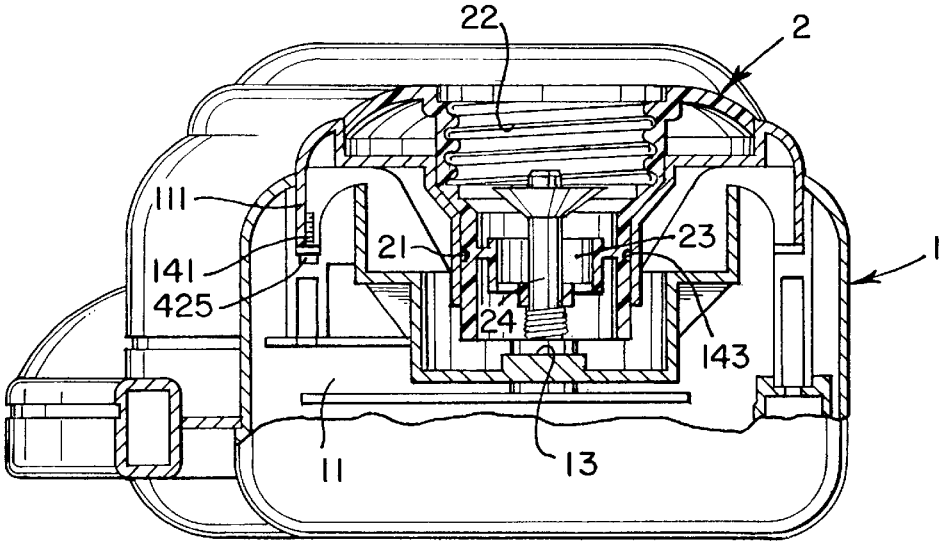
FIG. 3 is a sectional view of the humidifier of the present invention along the line 3—3 of FIG. 1.
Figure 4:
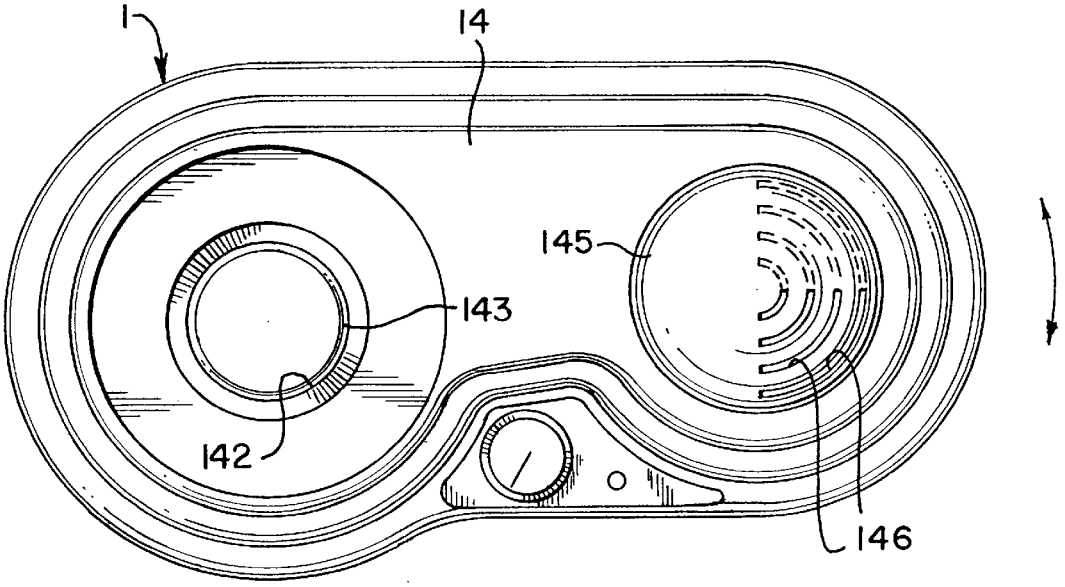
FIG. 4 is a top view of the humidifier of the present invention.
Figure 5:
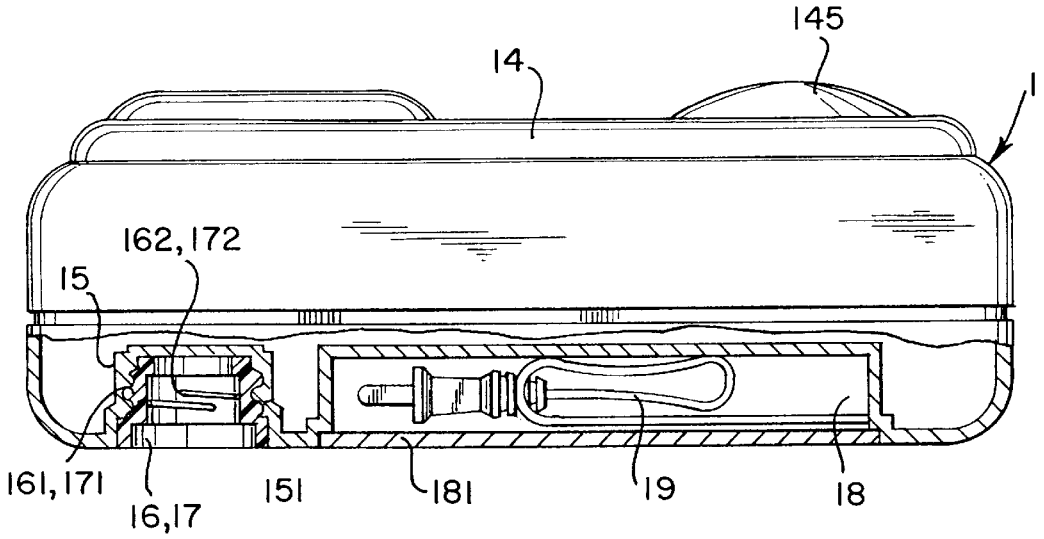
FIG. 5 is a fragmentary sectional view of the humidifier of the present invention.

Referring to FIGS. 1–4, a humidifier of the present invention includes a main body 1, a covering member 14, and a socket 2. The socket is designed to mate with and receive a water-containing bottle 3. As described below, the water containing bottle 3 may be any type of generally available liquid or water bottle, since the humidifier of the present invention is not limited to any specific type of specially adapted or configured water bottle.

The main body 1 includes a water containing chamber 11, two water detecting means 10 positioned in the water containing chamber 11, an ultrasonic vibrating member 12, a propping protrusion 13, and a covering member 14. The covering member 14 includes a rim which is detachably received in an annular connecting trench 111 of the main body 1. The propping protrusion 13, the water detecting means 10, and the ultrasonic vibrating member 12 are arranged on the base or floor of the water containing chamber 11.

A connecting hole 142 is provided on the covering member 14 and is positioned above the propping protrusion 13. The covering member 14 also includes a hole 144 for receiving a correspondingly shaped cover 145 which is detachably and rotatably fitted therein. The hole 144 is positioned in relation to the ultrasonic vibrating member 12. The cover 145 includes a number of vapor exit openings 146 which allow the water vapor to exit into the atmosphere adjacent the humidifier. The connecting hole 142 includes an annular protrusion 143 on the inner side of the wall thereof. A magnet 141 is fitted to the rim of the covering member 14.

The socket 2 is provided with inner screw threads 22 on its inner circumferential surface, and an annular recess 21 on its outer surface. The socket 2 also includes a through hole 23 on its lower end portion, which allows a valve 24 to pass through the socket 2. A liquid (e.g., water) container or bottle 3 is detachably connected to the socket by way of screw threads 31 on the bottle 3, which are engaged with the inner screw threads 22 of the socket 2.

The valve 24 received in the socket 2 prevents water inside the bottle 3 from flowing out when the bottle 3 is upside down. Specifically, the socket 2 and valve 24 are mated with the bottle 3 when the bottle 3 is preferably in an upright condition. Subsequently, the bottle 3 with the socket 2 and valve 24 attached, is turned upside down and inserted into the connecting hole 142 of the covering member 14. The annular recess 21 of the socket 2 engages the annular protrusion 143 of the wall of the connecting hole 142 provided on the covering member 14. This engagement causes the propping protrusion 13 of the main body 1 to prop up the valve 24 such that the valve 24 is opened (no longer blocking the bottle exit opening), allowing the water inside the bottle 3 to flow through the bottle exit opening into the water containing chamber 11 of the main body 1.

Figure 9:
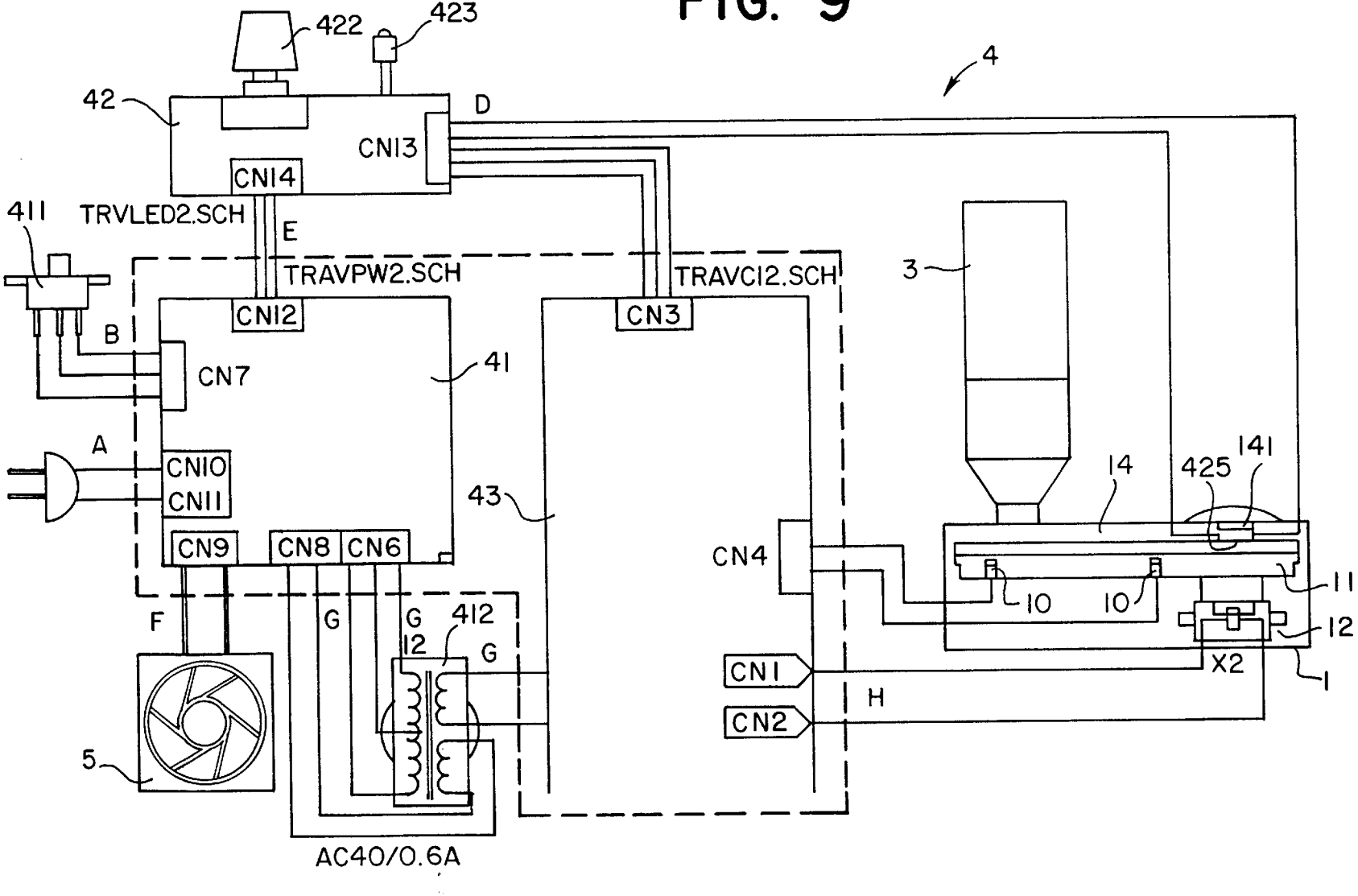
FIG. 9 is an electrical schematic diagram of the electrical portion of the humidifier according to the present invention.

With respect to the electrical control and operation of the humidifier, a main circuit board 4 is located inside the main body 1. Referring now to FIG. 9, therein is illustrated an electrical schematic diagram of the main circuit board 4, including a power supply control unit 41, a moisture adjusting unit 42 and an activating unit 43. The power supply control unit 41 includes a voltage-selecting unit 411, e.g., a switch, which allows the user to select the type of voltage power supply in the particular country where the user wishes to operate the humidifier. Input power is supplied to the humidifier via power plug A. The humidifier is then operated in accordance with the voltage supply selected by the user.

Figure 10:
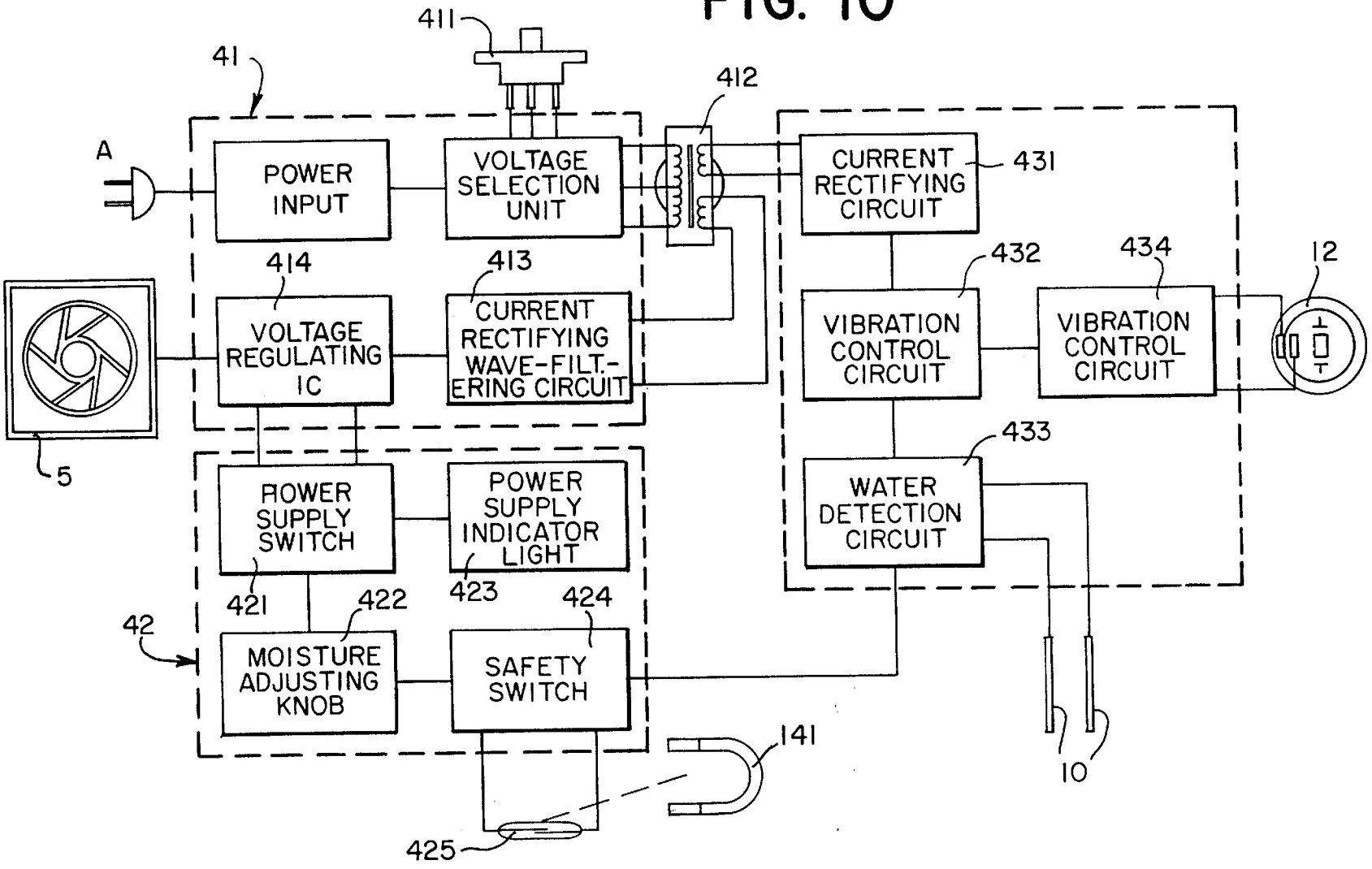
FIG. 10 is a block diagram of the humidifier according to the present invention.
Figure 11:
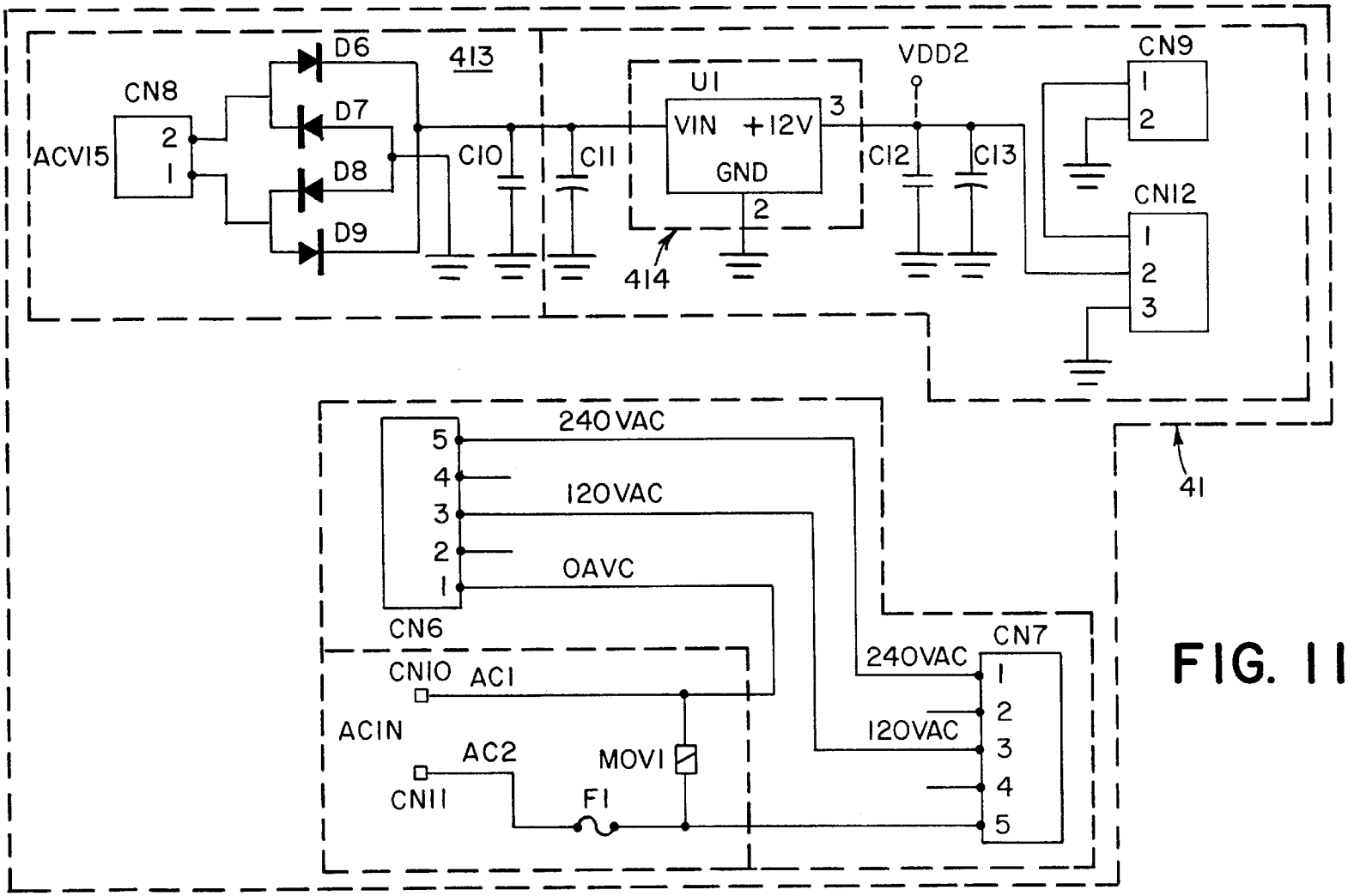
FIG. 11 is a circuit diagram of the power supply control unit of the humidifier according to the present invention.
Figure 12:
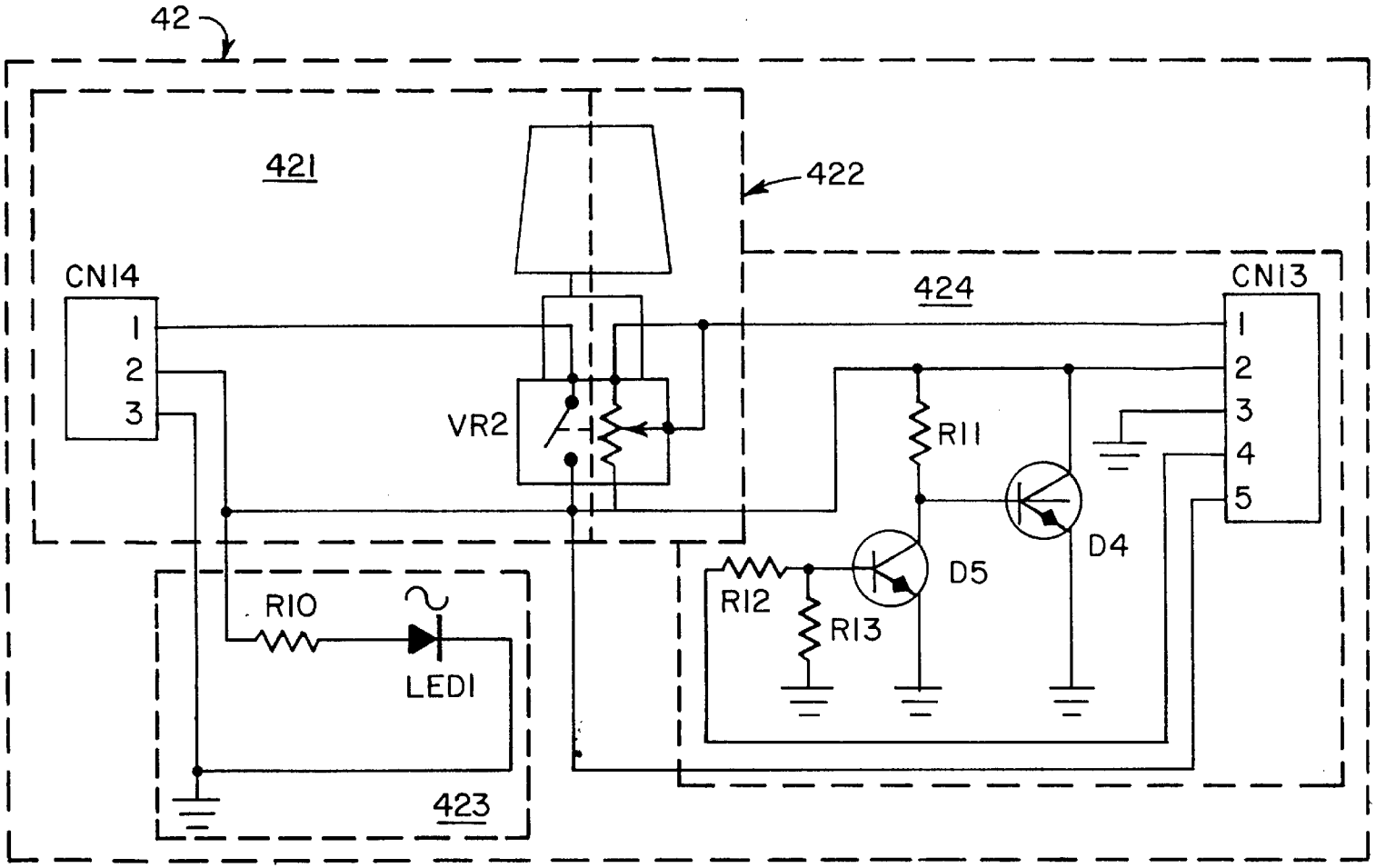
FIG. 12 is a circuit diagram of the moisture-adjusting unit of the humidifier according to the present invention.

Referring now to FIG. 10, a main transformer 412, is used to transform the power input by way of plug A into two separate power outputs. The first power output is provided to an electric fan 5 arranged inside the main body 1. The first power output is transformed into a direct current of, for example 12V, by a current rectifying and wave-filtering circuit 413, and a voltage regulating IC 414 before being provided to the fan 5.

The moisture adjusting unit 42 includes a power supply switch 421, which is electrically connected to a moisture adjusting knob 422, which may, for example, be controlled by the user to select the desired moisture level. The user can adjust the moisture adjusting knob 422 to control the amplitude of vibration of the vibration control circuit 434 for changing the amount of the produced vapor. When the power supply switch 421 is turned on, a power supply indicating light 423 is lighted.

A safety switch 424 is electrically connected to the moisture adjusting knob 422, and a magnetic switch 425, and allows the humidifier unit to operate only when the covering member 14 is properly mated with the main body 1. The magnetic switch 425 is positioned adjacent to the magnet 141 of the covering member 14 when the covering member 14 is firmly connected to the connecting trench 111 of the main body 1. As a result, the magnetic switch 425 will be turned on by the magnet 141 only when the rim of the covering member 14 is fitted in the connecting trench 111 of the main body 1 in a proper manner. Otherwise, the magnetic switch 425 is in a cut off state. When the magnetic switch 425 is in a cut off state, it prevents the safety switch 424 from passing control messages from the moisture adjusting knob 422. Conversely, when the magnetic switch 425 is on as a result of proper fitting of the covering member 14, the safety switch 424 will allow messages from the moisture adjusting knob 422 to be sent out via the safety switch 424.

Figure 13:
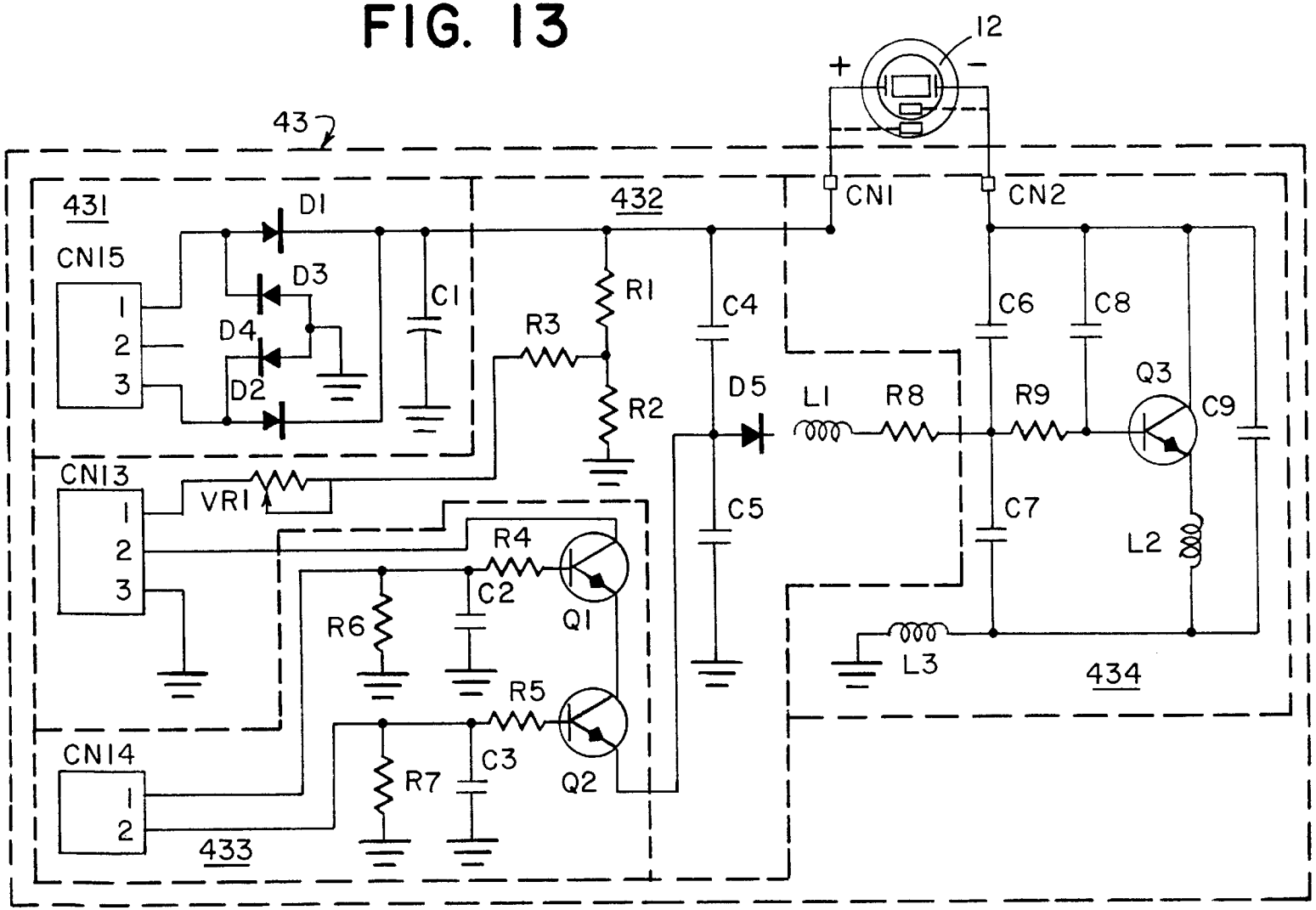
FIG. 13 is a circuit diagram of the activating unit of the humidifier according to the present invention.
Figure 15:
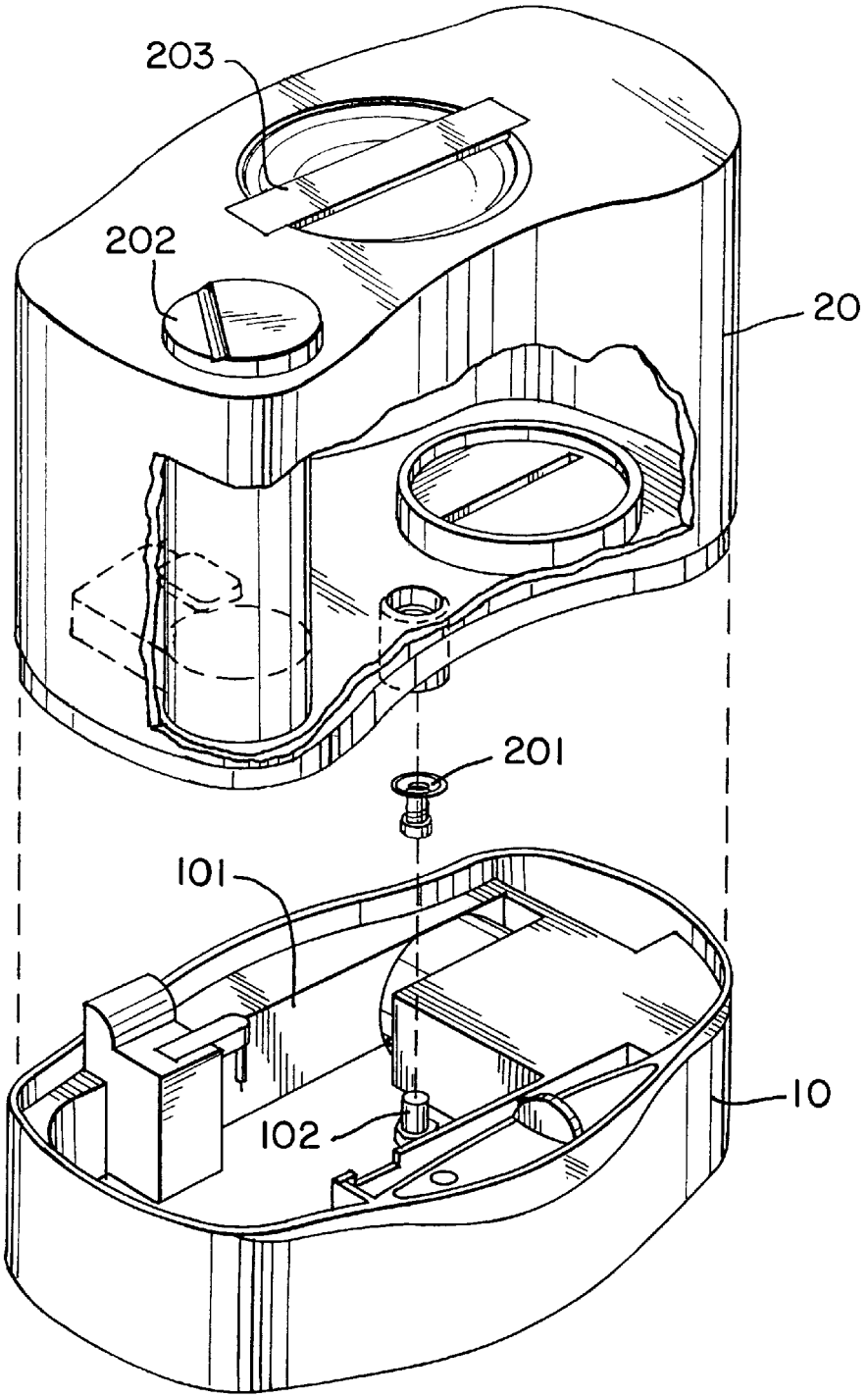
FIG. 15 PRIOR ART
FIG. 15 is a diagram of a prior art humidifier.

Referring now to FIG. 13, therein is shown an electrical schematic diagram of the activating unit 43, which includes a current rectifying circuit 431, vibration control circuit 432, a water detection circuit 433 and a vibration circuit 434. The second power output from the transformer 412 is rectified by the rectifying circuit 431. The rectified power output is passed from the rectifying circuit 431 to the vibration control circuit 432. As discussed above, the control messages from the moisture adjusting knob 422 (e.g., the user selected moisture level) are transmitted via the safety switch 424 to the water detection circuit 433, and then to the vibration control circuit 432. Thus, both the power and the control messages for making the ultrasonic vibrating member 12 start vibrating to produce water vapor are used to activate the vibration control circuit 434.

The water detection circuit 433 is electrically connected to the water detecting means 10 arranged in the water containing chamber 11. The water detecting means 10 may for example, be any one of a number of known water detection devices, including pressure transducers, conductivity detectors, humidity sensors,or temperature sensors. The water detection circuit 433 includes two transistors Q1, Q2 connected in series, with the emitter of Q1 connected to the collector of Q2. Each of the transistors Q1, Q2 is connected to a respective one of the water detecting means 10. When either one of the water detecting means 10 does not detect a sufficient level of water in the water containing chamber 11, the respective transistors Q1 or Q2 will be cut off. Because the transistors Q1, Q2 are connected in series, the output of the water detection circuit, i.e., the emitter of transistor Q2 will be at a low level, preventing the operation of the vibration control circuit 434. In this way, the control messages from the moisture-adjusting knob 422 will be prevented from reaching the vibration control circuit 434 due to the water detection circuit 433, with the result being that the vibration control circuit 434 will not be activated.

The cover 145 can be turned to adjust the direction of the vapor exit opening 146, to thereby direct the vapor emitted by the humidifier. Thus, referring to FIG. 4, the user can decide the direction in which the produced vapor comes out of the humidifier unit. An electric fan 5 blows out the produced vapor.

Figure 6:
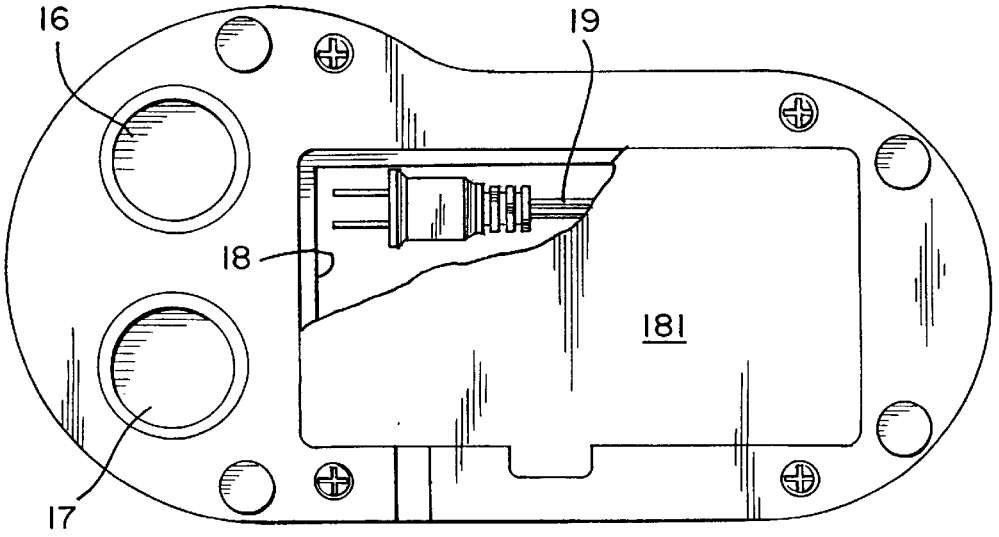
FIG. 6 is a bottom view of the humidifier of the present invention.
Figure 7:
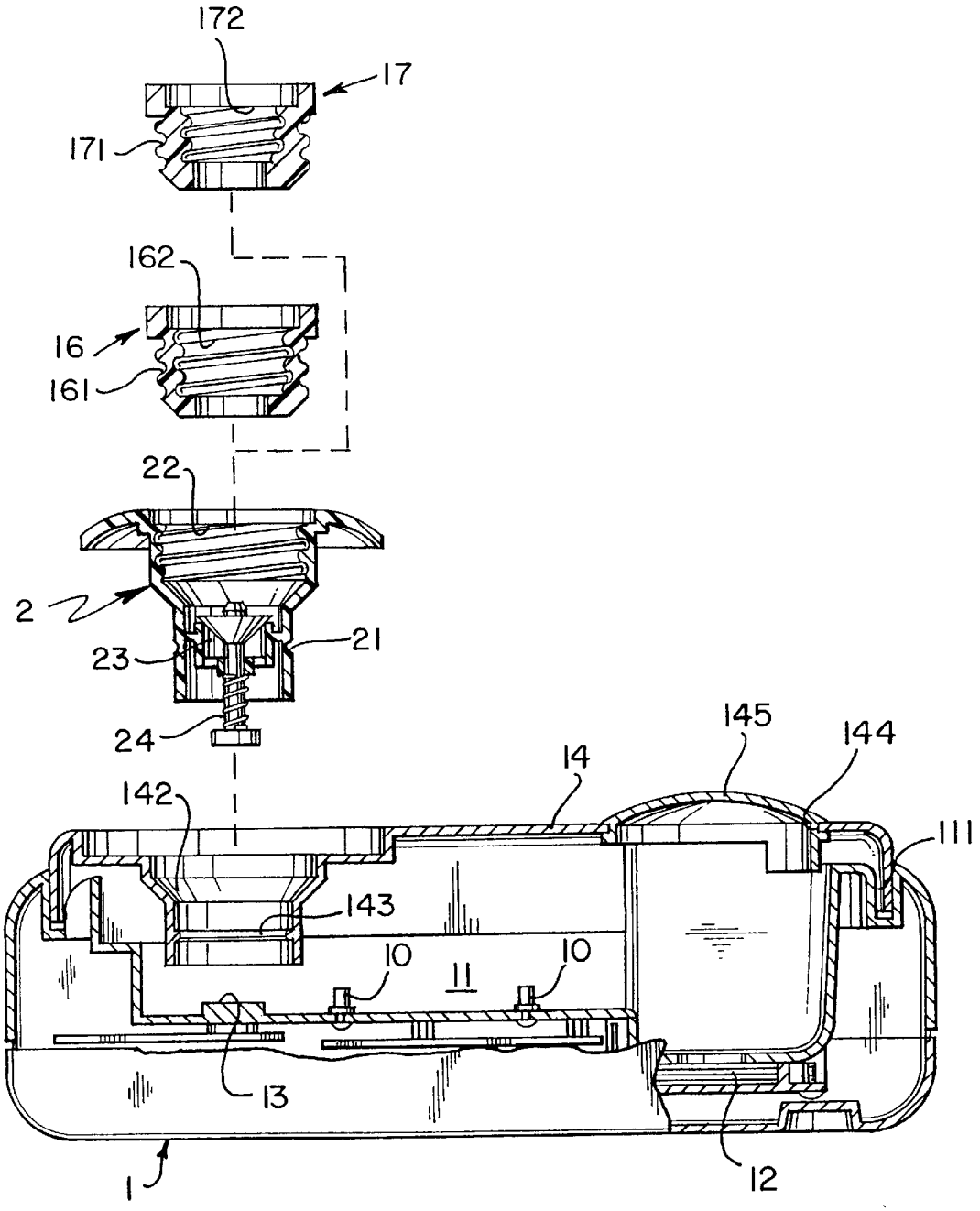
FIG. 7 is an exploded sectional view of an alternative embodiment according to the present invention.
Figure 8:
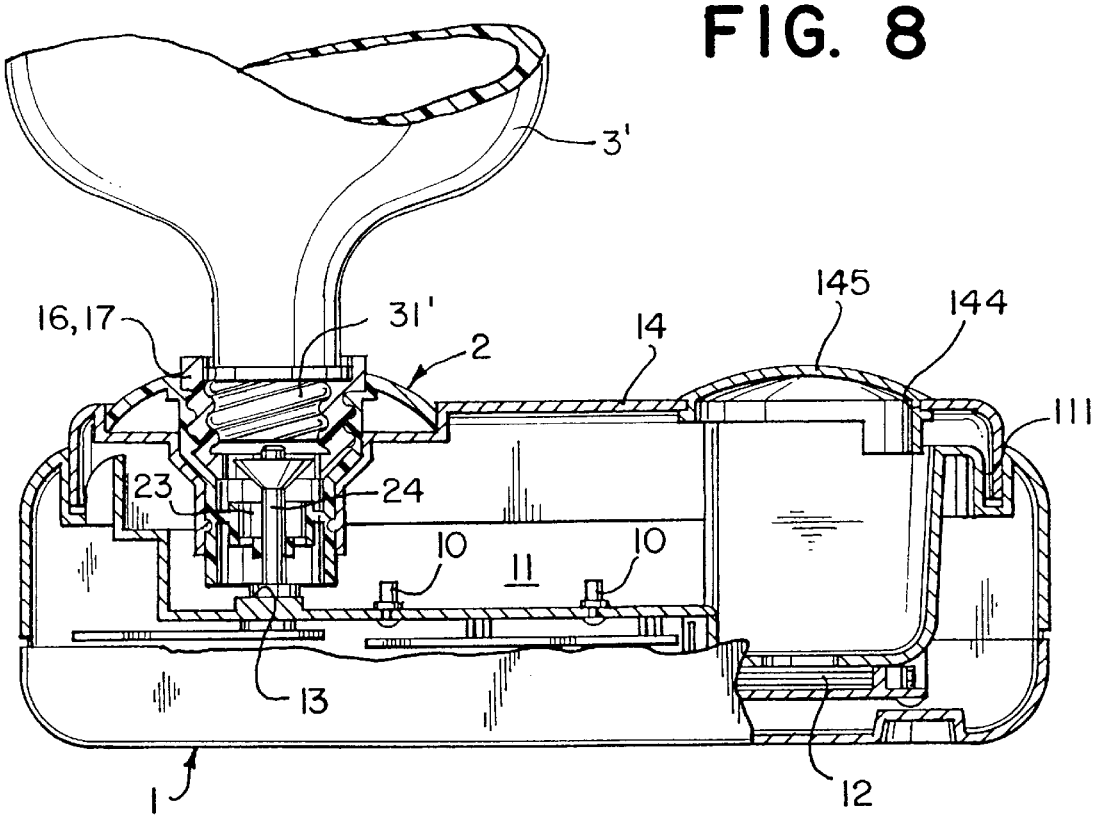
FIG. 8 is a detailed cross-sectional view of the humidifier shown in FIG. 7.
Figure 14:
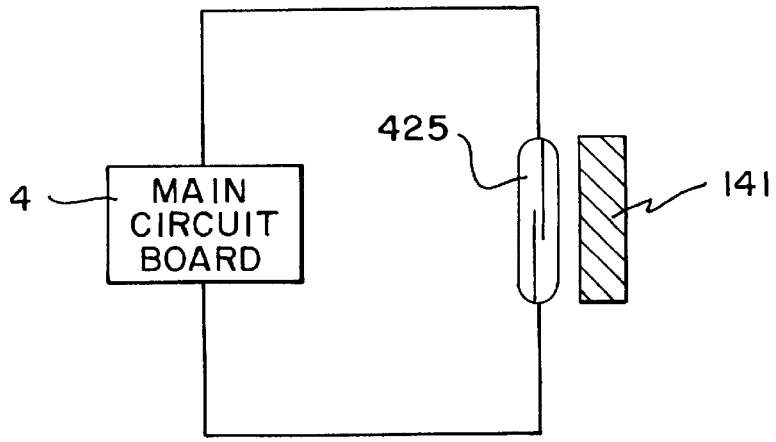
FIG. 14 is a diagram illustrating the magnetic switch, the magnet, and the main circuit board according to the present invention.

Referring to FIG. 6, holding rooms 15 and 18 are provided on the bottom of the main body 1. The holding rooms 15, 18 are provided with screw threads 151 on their inner circumference. Two sockets 16, 17, with respective screw threads 161, 171 on their outer circumference and respective screw threads 162, 172 on their inner circumference, may be received in the respective holding rooms 15, 18 by engaging either the inner or outer socket screw threads with the screw threads 151 in the holding rooms. The sockets 16 and 17 have different internal diameters allowing use of different size bottles 3. The sockets 16, 17 are detachably received in the holding rooms 15 when not in use, and are taken out to be used with the correspondingly sized bottle. The internal diameters of the sockets 2, 16, 17 are determined based on the size of commonly available bottles available on the market. In this way, the user can easily locate a bottle for use with the humidifier of the present invention. Based on the particular bottle selected by the user, the correspondingly sized socket is used. While two auxiliary sockets 16, 17 are show, a larger or smaller number of sockets may be used. Also, while the auxiliary sockets 16, 17 are shown as being received within holding rooms 15, 18 located on the underside of the humidifier main body, the auxiliary sockets may alternatively be provided in holding areas located elsewhere on the humidifier main body 1, or any other element associated with the humidifier, e.g., covering member 14 or an external covering. Alternatively, the auxiliary sockets may be provided as loose elements for use with the humidifier.

The cord 19 is housed inside the holding room 18 when not in use. A cover 181 further protects the holding room 18.

While the foregoing invention has been particularly shown and described with reference to a preferred embodiment thereof, it will be understood by those skilled in the art that various changes in form and details may be made therein without departing from the spirit and scope of the invention.

From the above description, it can be understood that the humidifier of the present invention has several desirable features, including:

1. The user does not have to carry a specially adapted or sized water container for the humidifier when traveling, making the humidifier extremely compact. One or more sockets or adapters may be provided with the humidifier to allow use of different size, commonly available water or liquid bottles.
2. Holding rooms 15 may be provided to hold the sockets 16, 17 when not in use, allowing the user to easily carry a number of different sized sockets along with the humidifier.
3. The bottle bought for use with the humidifier can be easily discarded or left behind whenever the user wants his/her luggage more compact when traveling.
4. When the covering member 14 is not properly coupled to the upper side of the main body 1, the magnetic switch will not be turned on by the magnet of the covering member, and thus the ultrasonic vibrating member will not be activated to produce vapor, thereby reducing or eliminating the risk of injury or improper operation.
5. A double safety water detecting means operates such that when either one of the water detecting means detects that there is not a sufficient level of water, the humidifier of the present invention is prevented from operating. In this manner, when the humidifier falls over or when the water runs out, the humidifier will not continue working, preventing any potential danger that might result therefrom, e.g. fire.
6. The humidifier is provided with a moisture-adjusting knob for the user to adjust the amount of vapor according to his/her need.
7. The humidifier is provided with a power supply-controlling unit so that it can be used in different countries using different power and voltage supplies.
8. The cord can be stored and protected in the holding room when not in use.

What is claimed is:

1. A humidifier comprising:

a main body including a fluid containing chamber having at least one water detecting means for detecting the presence of a predetermined level of water;

an ultrasonic vibrating member mounted in said main body in communication with said fluid containing chamber;

a covering member mated with said main body, said covering member including a first opening positioned relative to said vibrating member, and a second opening allowing fluid to be passed to said fluid containing chamber;

control means for preventing operation of said vibrating means based on the operation of said water detecting means;

at least one socket adapted to be received in said second opening, said at least one socket also being sized to interface with a conventional liquid container having a standard sized opening.

2. The humidifier of claim 1, further comprising a voltage selection circuit for operating the humidifier under different input voltage conditions.

3. The humidifier of claim 1, wherein said socket is adapted to interface to a water bottle.

4. The humidifier of claim 1, further comprising a plurality of different sized sockets, each said socket being sized to interface to a different sized water bottle.

5. The humidifier of claim 4, wherein said plurality of sockets are detachably mounted to said humidifier.

6. The humidifier of claim 1, wherein:

said main body further includes;

a cover detachably and rotatably received in said first opening, said cover having a plurality of vapor exit openings;

a propping protrusion formed on a base of said main body relative to said second opening;

said socket includes an annular recess for receiving a water exit portion of a water bottle being screwed into said socket, said socket being detachably received in said second opening of said main body, said socket having a through hole and a valve received in said through hole, said valve being capable of blocking said water in said bottle from flowing out when said bottle is inverted, said propping protrusion propping up said valve when said socket combined with said bottle is coupled to said main body to permit said water to flow through said through hole of said socket into said fluid containing chamber of said main body;

said ultrasonic vibrating member being capable of transforming said water in said fluid containing chamber into vapor form and is spread through said vapor exit openings.

7. The humidifier of claim 1, wherein:

said main body including two water detecting means, and a connecting trench, said trench arranged on an upper end portion of a circumference of said main body;

a propping protrusion in said water containing chamber;

a plurality of water detecting means arranged in said water containing chamber;

an electric fan;

said covering member having a rim detachably received in said connecting trench of said main body, said covering member second opening substantially arranged above said propping protrusion of said main body, said covering member having an annular protrusion on an inner side of a wall of said second opening, said covering member first opening receiving a cover therein, said cover having a plurality of vapor exit openings;

said socket includes an annular recess on an outer circumference thereof;

a through hole therein;

a valve passed into said through hole;

a screw thread on an inner circumference thereof, said socket being received in said second opening of said covering member with said annular recess thereof engaging said annular protrusion of said covering member, said valve being capable of blocking fluid from flowing through said through hole when said socket is not coupled to said second opening, said valve being propped up by said propping protrusion of said main body for permitting water to flow through said through hole when said socket is coupled to said second opening of said covering member;

said humidifier being adapted for use with a bottle having a screw thread on an outer circumference of an exit opening thereof, said bottle exit opening being screwed into said socket, said bottle having water contained therein;

said humidifier further comprising a main circuit board including a power supply control unit, said power supply control unit having a transformer for transforming input power into a first power output, and a second power output, said first power output being transmitted to said fan;

a moisture adjusting unit having a moisture adjusting knob, and a power supply switch, said moisture adjusting knob being provided for adjusting an amount of water vapor made by said humidifier;

an activating unit having a water detection circuit and a vibration control circuit, said water detection circuit having two transistors each electrically connected to a respective one of said water detecting means of said main body, said vibration control unit being electrically connected to said ultrasonic vibrating member, said second power output being rectified and then transmitted to said vibration control circuit, a message from said moisture adjusting knob being capable of being transmitted via said water detection circuit to said vibration control circuit when both said water detecting means detect the presence of water in said containing chamber, whereby said ultrasonic vibrating member is activated by said vibration control circuit in the presence of said water in said containing chamber to transform said water into vapor, which is then blown out through said vapor exit openings by said electric fan.

8. The humidifier of claim 1, wherein said main body further includes an electric fan for blowing water vapor.

9. The humidifier of claim 1, wherein said main body further includes a moisture adjusting means, said moisture adjusting means being electrically connected with said ultrasonic vibrating means for adjusting an amount of water vapor produced by said ultrasonic vibrating means.

10. The humidifier of claim 7, wherein said covering member includes a magnet on said covering member, and, a magnetic switch is provided between said moisture adjusting knob and said vibration control circuit, said magnetic switch being turned on by said magnet when said circumference of said covering member is firmly received in said connecting trench, and being otherwise cut off, whereby said vibrating control circuit is not capable of activating said ultrasonic member to produce vapor when said covering member is not fitted on said main body.

11. A humidifier comprising:

a main body including a fluid containing chamber having at least one water detecting means for detecting the presence of a predetermined level of water;

an ultrasonic vibrating member mounted in said main body in communication with said fluid containing chamber;

a covering member mated with said main body, said covering member including a first opening positioned relative to said vibrating member, and a second opening allowing fluid to be passed to said fluid containing chamber;

control means for preventing operation of said vibrating means based on the operation of said water detecting means; and a plurality of different sized sockets, each said socket being adapted to be received in said second opening and being sized to interface to a different sized water bottle.

12. The humidifier of claim 11, wherein said plurality of sockets are detachably mounted to said humidifier.

13. The humidifier of claim 11, further comprising a voltage selection circuit for operating the humidifier under different input voltage conditions.

14. The humidifier of claim 11 wherein each of said sockets is adapted to interface to a water bottle.

15. The humidifier of claim 11, wherein:

said main body further includes;

a cover detachably and rotatably received in said first opening, said cover having a plurality of vapor exit openings;

a propping protrusion formed on a base of said main body relative to said second opening;

each of said sockets includes an annular recess for receiving a water exit portion of a water bottle being screwed into said socket, each of said sockets being detachably received in said second opening of said main body, each of said sockets having a through hole and a valve received in said through hole, said valve being capable of blocking said water in said bottle from flowing out when said bottle is inverted, said propping protrusion propping up said valve when said socket combined with said bottle is coupled to said main body to permit said water to flow through said through hole of said socket into said fluid containing chamber of said main body;

said ultrasonic vibrating member being capable of transforming said water in said fluid containing chamber into vapor form and is spread through said vapor exit openings.

16. The humidifier of claim 11, wherein said main body further includes an electric fan for blowing water vapor.

17. The humidifier of claim 11, wherein said main body further includes a moisture adjusting means, said moisture adjusting means being electrically connected with said ultrasonic vibrating means for adjusting an amount of water vapor produced by said ultrasonic vibrating means.

18. A humidifier comprising:

a main body including a fluid containing chamber having at least one water detecting means for detecting the presence of a predetermined level of water;

an ultrasonic vibrating member mounted in said main body in communication with said fluid containing chamber;

a covering member mated with said main body, said covering member including a first opening positioned relative to said vibrating member, and a second opening allowing fluid to be passed to said fluid containing chamber;

control means for preventing operation of said vibrating means based on the operation of said water detecting means;

at least one socket adapted to be received in said second opening;

said main body including two water detecting means, and a connecting trench, said trench arranged on an upper end portion of a circumference of said main body;

a propping protrusion in said water containing chamber;

a plurality of water detecting means arranged in said water containing chamber;

an electric fan;

said covering member having a rim detachably received in said connecting trench of said main body, said covering member second opening substantially arranged above said propping protrusion of said main body, said covering member having an annular protrusion on an inner side of a wall of said second opening, said covering member first opening receiving a cover therein, said cover having a plurality of vapor exit openings;

said socket includes an annular recess on an outer circumference thereof;

a through hole therein;

a valve passed into said through hole;

a screw thread on an inner circumference thereof, said socket being received in said second opening of said covering member with said annular recess thereof engaging said annular protrusion of said covering member, said valve being capable of blocking fluid from flowing through said through hole when said socket is not coupled to said second opening, said valve being propped up by said propping protrusion of said main body for permitting water to flow through said through hole when said socket is coupled to said second opening of said covering member;

said humidifier being adapted for use with a bottle having a screw thread on an outer circumference of an exit opening thereof, said bottle exit opening being screwed into said socket, said bottle having water contained therein;

said humidifier further comprising a main circuit board including a power supply control unit, said power supply control unit having a transformer for transforming input power into a first power output, and a second power output, said first power output being transmitted to said fan;

a moisture adjusting unit having a moisture adjusting knob, and a power supply switch, said moisture adjusting knob being provided for adjusting an amount of water vapor made by said humidifier;

an activating unit having a water detection circuit and a vibration control circuit, said water detection circuit having two transistors each electrically connected to a respective one of said water detecting means of said main body, said vibration control unit being electrically connected to said ultrasonic vibrating member, said second power output being rectified and then transmitted to said vibration control circuit, a message from said moisture adjusting knob being capable of being transmitted via said water detection circuit to said vibration control circuit when both said water detecting means detect the presence of water in said containing chamber, whereby said ultrasonic vibrating member is activated by said vibration control circuit in the presence of said water in said containing chamber to transform said water into vapor, which is then blown out through said vapor exit openings by said electric fan.

19. The humidifier of claim 18, wherein said covering member includes a magnet on said covering member, and, a magnetic switch is provided between said moisture adjusting knob and said vibration control circuit, said magnetic switch being turned on by said magnet when said circumference of said covering member is firmly received in said connecting trench, and being otherwise cut off, whereby said vibrating control circuit is not capable of activating said ultrasonic member to produce vapor when said covering member is not fitted on said main body.

* * * * *